US005954340A

United States Patent [19]

Tedesco

[11] Patent Number: 5,954,340

[45] Date of Patent: Sep. 21, 1999

[54] MULTIPLE TIER TOKEN BALANCE GAME

[75] Inventor: Megan Tedesco, Irvine, Calif.

[73] Assignee: Mattel, Inc., El Segundo, Calif.

[21] Appl. No.: 09/133,344

[22] Filed: Aug. 13, 1998

[51] Int. Cl.[6] ..... A63B 67/00

[52] U.S. Cl. ..... 273/450; 273/449

[58] Field of Search ..... 273/450, 449, 273/440; 446/396, 325, 326

[56] References Cited

U.S. PATENT DOCUMENTS

| | | |
|---|---|---|
| 3,424,455 | 1/1969 | Dunson . |
| 3,614,106 | 10/1971 | Morrison et al. . |
| 3,863,918 | 2/1975 | Kramer . |
| 4,057,247 | 11/1977 | Morrison . |
| 4,303,240 | 12/1981 | Ellman et al. . |
| 4,522,393 | 6/1985 | Dunn . |
| 4,589,664 | 5/1986 | Slimp, Jr. . |
| 4,640,509 | 2/1987 | Manspeaker . |
| 4,708,342 | 11/1987 | Davis . |
| 4,744,567 | 5/1988 | Kochmanski et al. . |
| 4,932,655 | 6/1990 | Kurita . |
| 5,007,636 | 4/1991 | Pagani . |
| 5,072,936 | 12/1991 | Warehime . |
| 5,181,727 | 1/1993 | Fukumura . |
| 5,240,260 | 8/1993 | Strongin . |
| 5,332,231 | 7/1994 | McIntosh . |
| 5,480,159 | 1/1996 | Alsip . |
| 5,611,544 | 3/1997 | Grebler et al. . |
| 5,720,645 | 2/1998 | Duggan . |

FOREIGN PATENT DOCUMENTS

| | | | |
|---|---|---|---|
| 743827 | 10/1966 | Canada | 273/450 |

*Primary Examiner*—Raleigh Chiu
*Attorney, Agent, or Firm*—Roy A. Ekstrand

[57] ABSTRACT

A balance member is formed of a plurality of substantially planar rigid trunk elements arranged in a vertical stack and alternately oriented orthogonally to each adjacent trunk element. Each planar trunk element further supports a pair of oppositely positioned substantially horizontal tier members. A chance device and a plurality of tokens are provided to complete the game apparatus. The game is played by operating the chance device at the initiation of each player's turn to designate a particular tier level upon the balance member which the player must place a token successfully without tipping the balance member during each turn. The balance member is supported by a base having a downwardly convex preferably spherical surface which allows the balance member to tip in response to imbalances of token distribution caused by player placement of tokens.

14 Claims, 2 Drawing Sheets

MULTIPLE TIER TOKEN BALANCE GAME

FIELD OF THE INVENTION

This invention relates generally to games and particularly to those games utilizing a balancing structure in the game play.

BACKGROUND OF THE INVENTION

Throughout the years games have been and continue to be very popular entertainment items enjoyed by adults as well as children of virtually any age group. Not surprisingly, the long term popularity of games has resulted in the creation and proliferation of games in many forms. These varied forms of games have included card games, board games, memory games, and dexterity or skill games to name just a few. Perhaps one of the more exciting types of games is found in games which may be generally described as "balance skill games". Such balance skill games are themselves subject to substantial variety both as to game play and game apparatus. However, typically such balance skill games include some sort of center stack structure and weighted elements for tokens in which the game play activity utilizes either the accumulation or removal of weights or other types of game play tokens. The object in most such games is to avoid tumbling the center stack.

For example, U.S. Pat. No. 3,614,106 issued to Morrison et al sets forth a BALANCING PUZZLE DEVICE having a support base defining an upwardly extending cone and a plurality of balance members each having upper and lower portions configured for vertically stacking upon the base cone. Each of the balancing members supports a pair of outwardly and downwardly extending rods terminating in platforms which receive spherical weights. The game play involves placing weights upon the various platforms while endeavoring to avoid tipping the balanced array.

U.S. Pat. No. 4,932,655 issued to Kurita sets forth a BALANCING GAME HAVING AN ELASTIC SUPPORT POSITIONED BETWEEN UPPER AND LOWER HORIZONTAL SUPPORT PLATES. A plurality of weights are placed upon the upper plate causing the elastic support to deform and tip the plate.

U.S. Pat. No. 5,240,260 issued to Strogin sets forth a TOY GAME APPARATUS having a base supporting a bent rod extending vertically from the base and a plurality of body segments each having apertures therein which are stacked upon the rod. Each body portion or segment supports a pair of outwardly extending arms and upwardly faced hands which may receive weights placed thereon. Weights are placed upon the hands and the rod is rotated to gyrate the combined figure.

U.S. Pat. No. 3,424,455 issued to Dunson sets forth a BALANCE GAME APPARATUS having a center pivot supporting a balance arm which in turn defines a weight receptacle on each opposed end thereof. A plurality of weights are placed within the receptacles to balance the arm.

U.S. Pat. No. 3,863,918 issued to Kramer sets forth a BUILDING BLOCK GAME in which various blocks having different shapes are stacked one upon the other to attempt to reach a maximum height.

U.S. Pat. No. 4,057,247 issued to Morrison sets forth a BALANCING TOY SET having a base supporting a plurality of animal figures in a vertically stacked array. Each animal figure in turn supports an elongated balance beam having weights at the end thereof.

U.S. Pat. No. 4,303,240 issued to Ellman et al sets forth a MOVING BLOCK GAME having a base, a movable table mounted on the base, a drive system for powering the movable table, a designated playing area on the table and a plurality of playing blocks. The game is played by one or more players who sequentially place playing blocks of different sizes and shapes on the designated play area.

U.S. Pat. No. 4,522,393 issued to Dunn sets forth a CENTER OF GRAVITY BLOCK REMOVAL APPRAISAL AND BALANCING GAME in which a plurality of elongated rectangular blocks are initially arranged in criss-cross layers to form a vertical stack and in which players attempt to remove blocks from the stack while avoiding tilting or tumbling the stack.

U.S. Pat. No. 4,589,664 issued to Slimp, Jr. sets forth a TILTABLE BOARD GAME APPARATUS having a planar board supported by a center pivot beam upon which weights may be positioned.

U.S. Pat. No. 4,640,509 issued to Manspeaker sets forth a BALANCE GAME having a plurality of levels and fulcrums in association with weights which are shaped to be received in support relation on the levers.

U.S. Pat. No. 4,708,342 issued to Davis sets forth a BALANCING GAME AND METHOD having a rigid support member, a plurality of rigid headed elongated balance members and a planar storage member comprising the base for the rigid support member.

U.S. Pat. No. 4,744,567 issued to Kochmanski et al sets forth a DUCK ON THE ROCK having a game consisting of a plurality of playing pieces and a base member whereby one of the playing pieces is positioned on the base member and during play of the game, other playing pieces are placed serially upwardly on the first playing piece.

U.S. Pat. No. 5,007,636 issued to Pagani sets forth a GAME APPARATUS having a support base which in turn supports a pair of upwardly extending columns having a platform extending therebetween. A plurality of toy figure play pieces are balanced upon the support beam to form a pyramid arrangement.

U.S. Pat. No. 5,072,936 issued to Warehime sets forth a MAGNETIC MARBLES STACKING GAME AND APPARATUS having a base defining an upper surface upon which a plurality of magnetic marbles or magnetic game pieces are placed to form a cluster.

U.S. Pat. No. 5,181,727 issued to Fukumura sets forth a TOY GAME APPARATUS WITH VERTICALLY EXTENDABLE APPENDAGE having a figure defining a body portion and a vertically extendable semi-rigid appendage. An advancing mechanism within the body advances the appendage from a retracted position to an extended position while items are balanced upon the upper portion of the appendage.

U.S. Pat. No. 5,332,231 issued to McIntosh sets forth an EXECUTIVE BALANCE TOY having a plurality of precisely machined plates which interconnect and pivot with respect to one another to form a structure pivotable about two axes together with a play surface which does not pivot. The objective is to place as many weighted play pieces as possible on the play surface without causing it to tilt.

U.S. Pat. No. 5,480,159 issued to Alsip sets forth a GAME OF SKILL having a base element which in turn has a substantially horizontal dimensionally defined upper surface together with a plurality of uniformly thick playing pieces which are balanced by the players upon the horizontal surface.

U.S. Pat. No. 5,611,544 issued to Grebler et al sets forth a STACKING BRICK TOWER GAME in which a plurality of elongated rectangular bricks are initially arranged in a multi-tiered criss-cross vertical stack. Game play involves each player taking a turn attempting to remove a brick from the stack without toppling the stack.

U.S. Pat. No. 5,720,645 issued to Duggan sets forth a BALANCING TOY SET having a multi branched support from which a plurality of balancing members are interlockingly supported to form a tree-like mobile.

While the foregoing described prior art structures have in some circumstances provided improvement in the art and enjoyed commercial success, they have been also found to provide undue cost and complexity in facilitating game play. There exists therefore a need in the art for a simple cost effective and easily fabricated balancing game device which nonetheless provides interesting and amusing game play challenge.

SUMMARY OF THE INVENTION

Accordingly, it is a general object of the present invention to provide an improved balance game. It is a more particular object of the present invention to provide an improved balance game which may be readily fabricated of low cost components and which introduces an element of chance into the game play.

In accordance with the present invention, there is provided a game comprising: a base having an upper surface and a convex lower surface, a plurality of generally planar trunk elements, a plurality of tier elements, a plurality of tokens, a chance device for producing a random or pseudo-random number, first securing means for securing one of the trunk elements to the upper surface of the base, second securing means for securing the remaining ones of the trunk elements serially upwardly upon and from the one of the trunk elements in a rigid alternating orthogonal trunk, and third securing means for securing the tier elements to the trunk elements to form outwardly extending tiers supported by the trunk elements, the game being played by each player being required to place one or more of the tokens upon one or more of the tiers in response to a number given by the chance device.

BRIEF DESCRIPTION OF THE DRAWING

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figure 1:
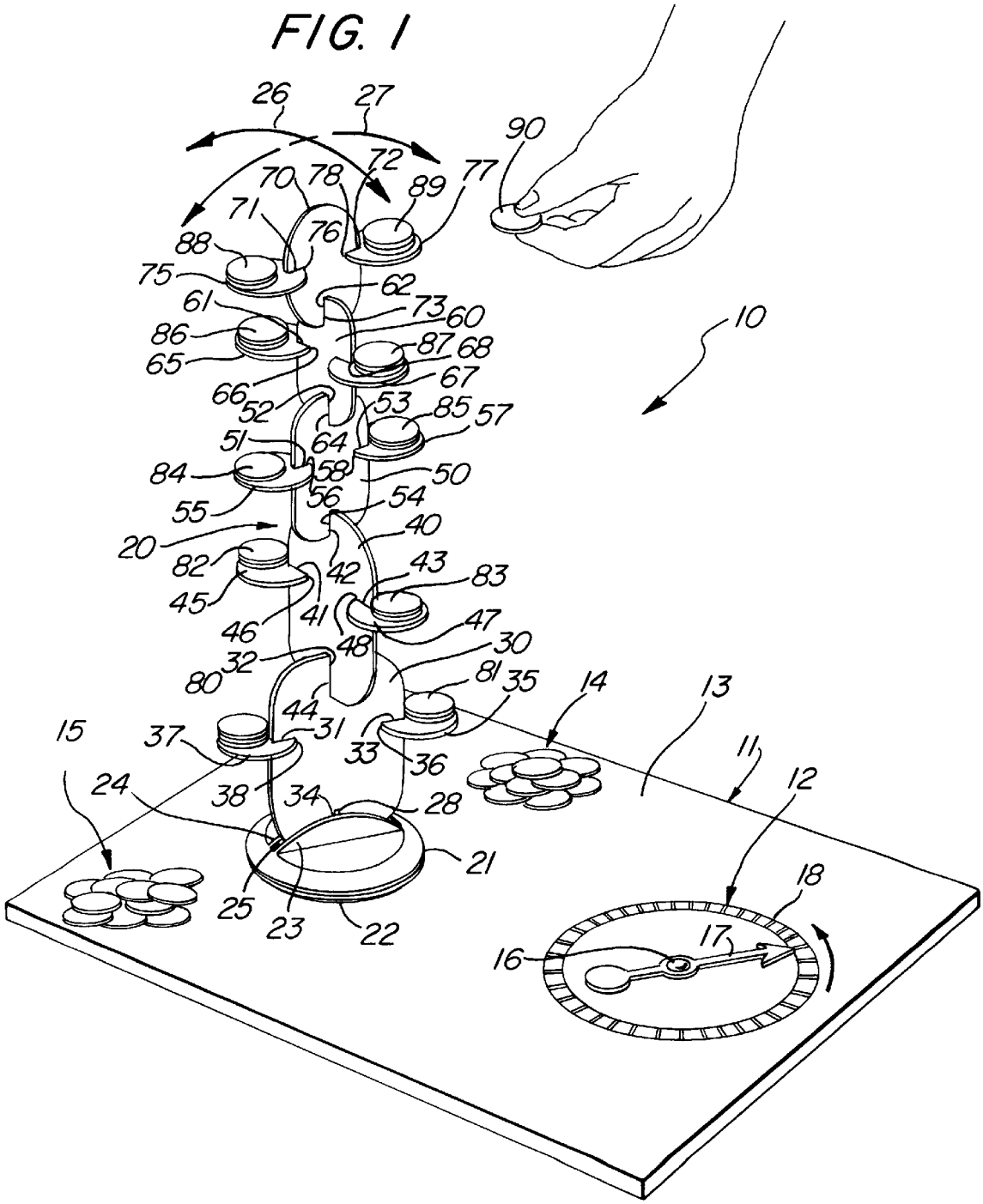
FIG. 1 sets forth a perspective view of the present invention multiple tier token balance game.

FIG. 1 sets forth a perspective view of a multiple tier token balance game constructed in accordance with the present invention and generally referenced by numeral 10. Game 10 includes a vertically free-standing balance member 20 which rests upon a base 21 having a convex undersurface 22. As a result, balance member 20 is tiltable in accordance with its weight distribution. As described below in greater detail and in accordance with an important aspect of the present invention, balance member 20 is rigid in its extension from base 21 and thus provides no weight distribution or weight compensation that is maximally sensitive to the distribution of weight upon the balance member. Game 10 further includes a plurality of tokens 14 and 15 shown in FIG. 1 distributed between two opposing players. However, it will be apparent that the present game is by no means limited to any particular number of players. The final elements of the present invention game is a chance device 12 which, in the embodiment shown in FIG. 1, is represented by a spinner 17. For purposes of convenience and in the preferred fabrication of the present invention game, a board 11 is provided to support chance device 12 and provide a play surface 13 upon which balance member 20 is received. It will be apparent, however, that the present invention game is not limited to the combination of a board 10 having a play surface and a support for the chance device. On the contrary, the present invention game may be played virtually any convenient surface such as a table top or the like and the chance device may be separated from the play surface.

More specifically, balance member 20 includes a base 21 preferably formed of a molded plastic material and having a structure set forth below in greater detail in FIGS. 2, 3, and 5. Suffice it to note here that base 21 defines a convex preferably spherical undersurface 22 and a pair of upwardly extending substantially parallel flanges 23 and 24. As is also better seen in FIGS. 2 and 3, a channel 25 is formed between parallel flanges 23 and 24 and a rib 28 extends between flanges 23 and 24 at the approximate center point of base 21.

Balance member 20 further includes a plurality of substantially planar, generally rigid trunk elements 30, 40, 50, 60, and 70 serially stacked upon base 21 in an alternating orthogonal pattern. Thus base 30 is formed of a rigid planar material and defines a plurality of slots 31, 32, 33, and 34, examples of which are better seen in FIG. 4. The lower end of trunk element 30 defining slot 34 is inserted forcibly in a tight fit between flanges 23 and 24 and within channel 25. As is better seen in FIG. 2, a plurality of inwardly extending projections are formed on the interior surfaces of flanges 23 and 24 to tightly secure the inserted portion of trunk element 30. In addition, slot 34 receives rib 28 as shown in FIG. 3 to fully secure trunk element 30 to base 21 in a rigid attachment.

Similarly, trunk element 40 is formed of a substantially rigid planar material and defines a plurality of slots 41, 42, 43, and 44. Trunk element 40 is rotated 90 degrees from trunk element 30 and is secured thereto by inserting the lower portion of trunk element 30 downwardly upon the upper portion of trunk element 30 having slots 44 and 32 of trunk elements 40 and 30 mutually aligned to provide a sliding engagement in which slot 32 of trunk element 30 extends beyond slot 44 of trunk element 40 and vice versa to secure the attachment of trunk elements 30 and 40. This type of attachment between two planar objects is well known in the art and forms the type of attachment between the various trunk elements and tier elements forming balance member 20.

Trunk element 50 is formed of a generally planar rigid material and defines a plurality of slots 51, 52, 53, and 54 and is secured to trunk element 40 in a 90 degree rotation through the cooperation of slot 42 of trunk element 40 and slot 54 of trunk element 50. Thus trunk element 50 is substantially coplanar with trunk element 30 and is orthogonal to trunk element 40.

Trunk element 60 is formed of a substantially planar rigid material and defines a plurality of slots 61, 62, 63, and 64 therein. The lower portion of trunk element 60 is secured to the upper portion of trunk element 50 using the above-described orthogonal positioning and slot engagement in which slot 52 of trunk element 50 is received upon the lower portion of trunk element 60 while slot 64 thereof is received upon the upper portion of trunk element 50.

Trunk element 70 forms the uppermost trunk element of balance member 20 and is also formed of a substantially planar rigid material defining slots 71, 72, and 73. Trunk element 70 is rotated 90 degrees to trunk element 60 and secured thereto by the engagement of slots 73 and 62 of trunk elements 70 and 60, respectively.

The resulting combination of trunk elements 30, 40, 50, 60, and 70 assembled in the engagement described above provides a center trunk portion for balance member 20 which is three dimensional in character and rigid in structure extending upwardly from base 21 to form a secure rigid and high strength member notwithstanding its fabrication from planar materials such as molded plastic, die cut cardboard, or other materials. In further accordance with the present invention, a plurality of outwardly extending substantially horizontal tiers are secured to opposed sides of each of trunk elements 30, 40, 50, 60, and 70 using a cooperating slot engagement of the type described for the trunk element couplings and shown in an exemplary fashion in FIG. 4.

More specifically, balance member 20 includes a tier 35 having a generally circular shape and defining a slot 36 therein. Tier 35 is secured to one side of trunk element 30 by the cooperation of slot 36 formed in tier 35 and slot 33 formed in trunk element 30. As mentioned, this attachment is shown in greater detail in FIG. 4. As should be understood, the example of the attachment of tier 35 to trunk element 30 shown in greater detail in FIG. 4 should be understood to be equally descriptive of the attachment of the remaining tiers of balance member 20 to their respective trunk elements. Accordingly, balance member 20 further includes a tier 37 having a slot 38 formed therein which is secured to the opposite side of trunk element 30 by the cooperation of slots 31 and 38. Once again the details of this attachment are shown for illustration in FIG. 4 and should be understood to be equally illustrative of the attachment of the remaining tier elements.

Thus in a similar attachment balance member 20 includes tiers 45 and 47 having slots 46 and 48 respectively formed therein which are secured to trunk element 40 using cooperating slots 41 and 43. similarly, a pair of tier members 55 and 57 having slots 56 and 58 formed respectively therein are secured to opposed sides of trunk element 50 through the cooperative engagement of slots 56 and 58 of the tier elements with slots 51 and 53 of trunk element 50. An additional pair of tier elements 65 and 67 having slots 66 and 68 respectively formed therein are secured to opposed sides of trunk element 60 using the cooperation of slots 66 and 68 of the tier elements with slots 61 and 63 of trunk element 60.

Finally a pair of tier elements 75 and 77 having slots 76 and 78 respectively formed therein are secured to opposed sides of trunk element 70 through the cooperation of slots 76 and 78 with slots 71 and 72, respectively, of trunk element 70.

As thus far described, balance member 20 is completely assembled and forms a center trunk member of interlocking trunk elements and a plurality of outwardly extending substantially horizontal tier elements which are positioned at a plurality of different levels of balance member 20. It will be apparent that in the absence of tokens placed upon the tier elements, balance member 20 is substantially symmetrical in weight distribution about the center of convex surface 22 of base 21. As a result balance member 20 if left undisturbed and unencumbered by token elements stands generally vertically. In further accordance with the present invention, a plurality of tokens 14 and 15 are distributed to each opposing player at the initiation of game play. It will ba apparent that tokens may be evenly distributed by various numbers of opposing players and that the present invention is not limited to any particular number of players. Finally game 10 includes a chance device 12 which in the example shown includes a spinner 17 rotatably secured to board 11 by a pin 16 and having a plurality of indicia 18 encircling the path of rotation of the pointed end of spinner 17. In accordance with conventional fabrication techniques, spinner 17 is spun by a player to provide a random chance number selection from indicia 18 at the point at which spinner 17 stops. It would be apparent to those skilled in the art, however, that an alternative chance device may be used without departing from the spirit and scope of the present invention so long as it provides a random or pseudo-random number selection to be usable in game play. Thus chance devices which are the equivalent of chance device 12 for this function include one or more dice, numeric cards, or if desired, a random or pseudo-random number generator which operates in an electronic circuit and display. The essential function of chance device 12 however provided is the creation of a chance number for each player at the commencement of their respective turns.

During game play, balance member 20 is initially empty and the tokens are distributed substantially evenly between opposing players. Each player thereafter takes a turn initiated by spinning pointer 17 of chance device 12 and in response to the number indicated by the chance device, placing a token from their token quantity upon a tier of balance member 20. In the anticipated play pattern of the present invention game, the plurality of locations or spaces of indicia 18 correspond numerically to the tier levels of balance member 20. For example, the numeral 1 may correspond to the level occupied by tier members 35 and 37 while the numeral 2 may correspond to the level occupied by tier members 45 and 47 with numeral 3 corresponding to the level occupied by tier members 55 and 57, and so on. The uppermost tier being the level occupied by tier members 75 and 77. Thus a player having spun pointer 17 may, for example, be presented with the numeral 4. In such case, the objective of the player is to analyze the condition of balance of balance member 20 and decide whether to place the next token upon tier 65 or alternatively tier 67 to complete the appointed task. It will be apparent that once tokens begin accumulating upon the various tiers of balance member 20 considerable challenge is presented to the player in deciding which of the two tier elements to place a token upon and to decide the most optimum placement of the token upon the selected tier element. The overall objective of each player is to successfully place their tokens during each turn upon the assigned tiers of balance member 20 while avoiding the game losing consequence of tipping base member 20 and toppling the base member to cause the accumulated tokens thereon to fall from the supporting tiers. This consequence is, of course, a game loss for the player having such an unsuccessful turn and the other player becomes the winner.

The game play continues as each player takes a turn operating chance device 12 and in response to the numeral provided thereby, placing tokens from their token supply upon the indicated tier level of balance member 20. For purposes of illustration, FIG. 1 shows balance member 20 having pluralities of tokens 80 through 89 accumulated upon the various tiers of balance member 20. In further illustration, FIG. 1 shows a player's hand in the process of attempting to place a token 90 upon the assigned tier level of balance member 20.

Game play may be varied somewhat utilizing the apparatus of game 10 in several ways. For example, if a number of players are playing, the game rules may include an alternative exercisable by a player to "pass" and choose not to take a token from the player's token supply in view of the risk associated with the particular tier which chance device 12 has given that player. In such a game play variation, an additional aspect of game play rules is desirable in which the winner among a plurality of players becomes the player to first exhaust their supply of tokens. In this manner, the choice of assuming the risk of placing a token upon balance member 20 as dictated by chance device 12 and risking a tumble or game losing imbalance to balance member 20 is weighed against the inability to delete the player's supply of tokens. Other variations are possible and a number of creative game play patterns may be exercised using the apparatus of game 10.

In accordance with an important advantage of the present invention game, the apparatus is readily fabricated of planar material such as rigid cardboard or molded plastic and thus balance member 20 may be stored conveniently by disassembling trunk elements 30, 40, 50, 60, and 70 from each other and from base 21 during storage or transport and assembling the balance member when needed. It will be apparent to those skilled in the art that notwithstanding the three-dimensional character of balance member 20 provided by its novel structure, the entire assembly may be stored in an extremely limited space. This space may be further limited by disassembling balance member 20 completely by removing the respective tier member pairs from each trunk element. As a result, balance member in its entirety including trunk elements and supported tiers with the exception of base 21 may be fabricated of a die cut planar sheet of rigid cardboard or other suitable material.

Figure 2:
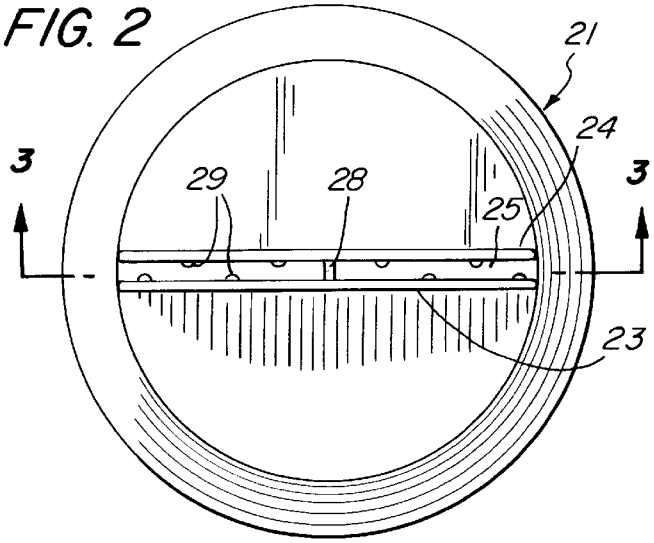
FIG. 2 sets forth a top view of the base portion of the present invention multiple tier token balance game.

FIG. 2 sets forth a top view of base 21 having trunk element 30 removed therefrom. As mentioned above, base 21 is preferably formed of a molded plastic material and as is seen in FIG. 3, includes a center weight 102 which increases the stability of base 21. Base 21 is circular in shape and supports a pair of upwardly extending substantially planar parallel flanges 23 and 24. The spacing of flanges 23 and 24 forms a channel 25 therebetween. A rib 28 sized to be receivable within slot 34 of trunk element 30 (seen in FIG. 3) extends between flanges 23 and 24 traversing channel 25. In addition, a plurality of inwardly extending projections 29 are formed on the interior surfaces of flanges 23 and 24. Projections 29 provide engagement with the lower portion of trunk element 30 to rigidly and tightly secure the lower portion of trunk element 30 within channel 25. Rib 28 engages slot 34 (seen in FIG. 3) to further engage and secure trunk element 30 to base 21.

Figure 3:
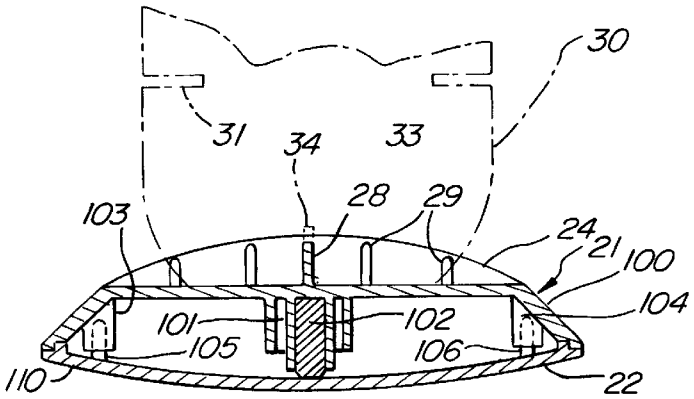
FIG. 3 sets forth a section view of the base shown in FIG. 2 taken along section lines 3—3 therein.

FIG. 3 sets forth a section view of base 21 taken along section lines 3—3 in FIG. 2. As described above, base 21 is generally circular in shape and supports trunk element 30 shown in dashed line representation. Base 21 is preferably formed of a pair of mating portions formed by upper portion 100 and lower portion 110. Upper portion 100 supports flanges 23 and 24 (the former seen in FIG. 2). In addition upper portion 100 defines a plurality of interior bosses such as bosses 103 and 104 together with a center boss 101. A center weight 102 preferably formed of a metal or other heavy material is received and supported within boss 101 in a simple press fit installation. The function of weight 102 is to increase the stability and resistance to tipping of balance member 20 in the above-described game play.

Lower portion 110 defines a convex surface 22 which is preferably spherical to provide even multi direction balancing of base 21 and which includes a plurality of upwardly extending posts such as posts 105 and 106 receivable within respective bosses such as bosses 103 and 104 of upper portion 100 to secure lower portion 110 to upper portion 100. A simple snap fit between the pluralities of posts and their respective bosses will adequately secure lower portion 110 to upper portion 100. However, additional attachments such adhesive or thermal or sonic welding may be utilized if desired.

The resulting structure of base 21 is configured to receive trunk element 30 in the above-described attachment allowing base 21 to support balance member 20 in the above-described game play.

Figure 4:
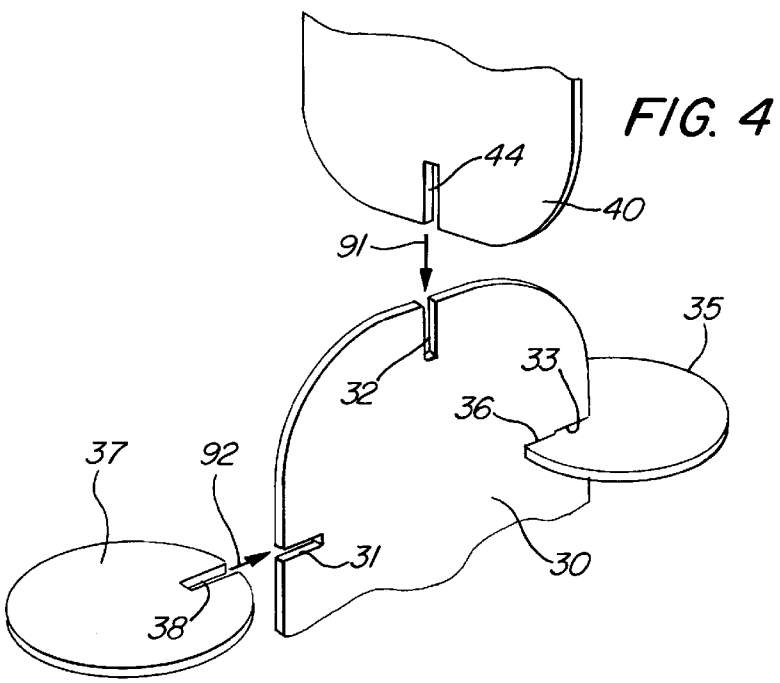
FIG. 4 sets forth a perspective partial view of the interlocking elements of the present invention multiple tier token balance game.

FIG. 4 sets forth a partial perspective assembly view of a portion of balance member 20 showing the attachment of trunk elements 30 and 40 together with the attachment of tier members 35 and 37. As described above, the trunk elements such as trunk elements 30 and 40 of balance member 20 (seen in FIG. 1) are preferably formed of a rigid planar material such as rigid cardboard, molded plastic, or other suitable fabrications. As is also described above, a plurality of tier members such as tier members 35 and 37 are secured to the various trunk elements of balance member 20 in the manner shown in FIG. 1.

More specifically, trunk element 30 includes a plurality of slots including slots 31, 32, and 33 while trunk element 40 defines a plurality of slots including downwardly facing slot 44. In accordance with the invention, trunk element 30 and trunk element 40 are assembled by positioning trunk element 40 orthogonally with respect to trunk element 30 and aligning slots 44 and 32. Thereafter movement of trunk element 40 downwardly as indicated by arrow 91 assembles trunk element 40 to trunk element 30 in an overlapping engagement in which slot 44 extends beyond slot 32 upon trunk element 30 and slot 32 extends beyond slot 44 upon trunk element 40.

Similarly, tier members 35 and 37 having slots 36 and 38 respectively formed therein are assembled opposed sides of trunk element 30 by a similar cooperating engagement of slots. Thus, for example, tier member 37 is positioned in an orthogonal relationship with trunk element 30 and slot 38 is aligned with slot 31 therein. Thereafter tier 37 is moved in the direction indicated by arrow 92 passing a portion of tier 37 through slot 31 and passing a portion of trunk element 30 through slot 38. The resulting attachment is shown in the assembly of tier 35 to trunk element 30. Slot 36 of tier member 35 extends beyond slot 33 of trunk element 30 while slot 33 of trunk element 30 extends beyond slot 36 of tier member 35. The resulting engagement horizontally positions tiers 35 and 37 upon opposed sides of trunk element 30. As mentioned above, the assembly of tier members 35 and 37 and the assembly of trunk element 40 to trunk element 30 shown in FIG. 4 is descriptive and illustrative of the corresponding assemblies of tier members and trunk elements described above in FIG. 1.

Figure 5:
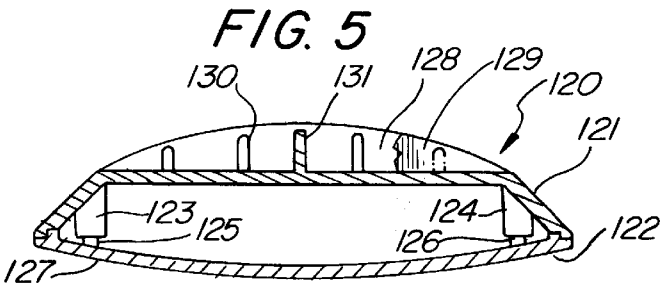
FIG. 5 sets forth a section view of an alternate embodiment of the base of the present invention multiple tier token game.

FIG. 5 sets forth a section view of an alternative embodiment of the present invention having a base member 120. Base member 120 is substantially the same as base member 21 and is secured to trunk element 30 in the same manner as described for base 21. The difference between base 120 and base 21 is found in the elimination of boss 101 and center weight 102 (seen in FIG. 3). The elimination of a center weight from base 120 renders the resulting balance member formed by attaching trunk elements and tier members as shown in FIG. 1 to be substantially less stable and therefore substantially more challenging than the apparatus provided with the use of a center weight. Thus base 120 is circular in shape and virtually identical to the circular shape of base 21 shown in FIG. 2 and is formed of an upper portion 121 matingly joined to a lower portion 122. By further similarity, lower portion 122 defines a convex, preferably spherical surface 127. Lower portion 122 supports a plurality of upwardly extending posts such as posts 125 and 126 while upper portion 121 supports corresponding pluralities of attachment bosses such as bosses 123 and 124. Finally, upper portion 121 supports a pair of upwardly extending substantially parallel flanges 128 and 129. Flanges 128 and 129 receive the bottom portion of trunk element 30 in the manner shown in FIG. 3 for base 21 and thus include a rib 131 and a plurality of inwardly extending projections 130.

What has been shown is a multiple tier token balance game which is conveniently fabricated of a plurality of planar members and elements to form a three-dimensional multi-tiered balance member which receives corresponding pluralities of tokens distributed by players in response to a chance device. The game shown is capable of play by a variety of player numbers and is challenging to play while relatively simple to learn. The entire game apparatus may be repeatedly assembled and disassembled for convenient storage and transport in a relatively small container due to the flat character of the elements used in fabricating the balance member of the game device.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game comprising:

a base having an upper surface and a convex lower surface;

a plurality of generally planar trunk elements;

a plurality of tier elements;

a plurality of tokens;

a chance device for producing a random or pseudo-random number;

first securing means for securing one of said trunk elements to said upper surface of said base;

second securing means for securing the remaining ones of said trunk elements serially upwardly upon and from said one of said trunk elements in a rigid alternating orthogonal trunk; and third securing means for securing said tier elements to said trunk elements to form outwardly extending tiers supported by said trunk elements, said game being played by each player being required to place one or more of said tokens upon one or more of said tiers in response to a number given by said chance device.

2. The game set forth in claim 1 wherein said first securing means includes a channel formed in said upper surface and a generally planar lower end formed on said one of said trunk elements tightly inserted therein.

3. The game set forth in claim 2 wherein each of said trunk elements define upper and lower ends and respective upwardly and downwardly open slots and wherein said second securing means includes the engagement of each upper and lower end of adjacent trunk elements using respective ones of said slots.

4. The game set forth in claim 3 wherein each of said trunk elements define opposed sides having outwardly open opposed slots therein and wherein each of said tier elements define an outwardly open slot therein, said slots of said tier elements each engaging a slot in a trunk element to provide said third securing means.

5. The game set forth in claim 4 wherein said base further includes a center weight.

6. The game set forth in claim 4 wherein said first securing means further includes a rib extending between said flanges transversely of said channel and a slot formed in said lower end for receiving said rib.

7. The game set forth in claim 6 wherein said first securing means further includes a plurality of projections formed on said flanges within said channel.

8. The game set forth in claim 2 wherein said first securing means further includes a rib extending between said flanges transversely of said channel and a slot formed in said lower end for receiving said rib.

9. The game set forth in claim 8 wherein said first securing means further includes a plurality of projections formed on said flanges within said channel.

10. The game set forth in claim 2 wherein said first securing means further includes a plurality of projections formed on said flanges within said channel.

11. The game set forth in claim 1 wherein said base further includes a center weight.

12. The game set forth in claim 1 wherein each of said trunk elements define upper and lower ends and respective upwardly and downwardly open slots and wherein said second securing means includes the engagement of each upper and lower end of adjacent trunk elements using respective ones of said slots.

13. The game set forth in claim 12 wherein each of said trunk elements define opposed sides having outwardly open opposed slots therein and wherein each of said tier elements define an outwardly open slot therein, said slots of said tier elements each engaging a slot in a trunk element to provide said third securing means.

14. The game set forth in claim 1 wherein each of said trunk elements define opposed sides having outwardly open opposed slots therein and wherein each of said tier elements define an outwardly open slot therein, said slots of said tier elements each engaging a slot in a trunk element to provide said third securing means.

* * * * *